United States Patent [19]

Easom

[11] Patent Number: 4,998,965

[45] Date of Patent: Mar. 12, 1991

[54] FEEDING DEVICE HAVING CONTROL MEANS, FEED ROLLERS, A PULSE GENERATOR AND A PHOTOELECTRIC DEVICE FOR DIRECTLY MEASURING RATE OF FEED OF AN ELASTIC STRIP HAVING MARKS THEREON FOR A SEWING MACHINE

[76] Inventor: Peter W. Easom, Bakery Cottage, New Road, Burton Lazars, Melton Mowbray, Leicestershire, LE14 2UU, United Kingdom

[21] Appl. No.: 382,680

[22] PCT Filed: Feb. 25, 1988

[86] PCT No.: PCT/GB88/00132

§ 371 Date: Oct. 13, 1989

§ 102(e) Date: Oct. 13, 1989

[87] PCT Pub. No.: WO88/09408

PCT Pub. Date: Dec. 1, 1988

[30] Foreign Application Priority Data

Feb. 26, 1987 [GB] United Kingdom ..... 8704536

[51] Int. Cl.[5] ..... D05B 27/10; D05B 35/06

[52] U.S. Cl. ..... 112/305; 112/121.26; 112/152; 112/313; 112/318; 112/121.27; 112/307

[58] Field of Search ..... 112/104, 113, 121.11, 112/121.12, 121.26, 121.27, 121.29, 130, 136, 137, 152, 303, 304, 305, 307, 318, 322

[56] References Cited

U.S. PATENT DOCUMENTS

| | | | |
|---|---|---|---|
| 3,721,203 | 3/1973 | George | 112/121.26 |
| 3,856,224 | 12/1974 | Van der Aa | 112/121.27 X |
| 4,030,429 | 6/1977 | Boser | 112/104 |
| 4,303,027 | 12/1981 | Uemura | 112/121.26 |
| 4,377,122 | 3/1983 | Boser | 112/265.1 |
| 4,389,951 | 6/1983 | von Hagen | 112/307 X |
| 4,590,874 | 5/1986 | Baclagis | 112/305 X |
| 4,635,575 | 1/1987 | Schips | 112/121.26 |
| 4,703,706 | 11/1987 | Plante | 112/104 X |

FOREIGN PATENT DOCUMENTS

| | | |
|---|---|---|
| 0165380 | 12/1985 | European Pat. Off. . |
| 3007652 | 9/1981 | Fed. Rep. of Germany . |
| 8217525 | 10/1982 | France . |
| 8304713 | 3/1983 | France . |
| 1455065 | 11/1976 | United Kingdom . |
| 2103189 | 2/1983 | United Kingdom . |
| 2110190 | 6/1983 | United Kingdom . |
| 2120808 | 12/1983 | United Kingdom . |
| 2152016 | 7/1988 | United Kingdom . |

*Primary Examiner*—Werner H. Schroeder
*Assistant Examiner*—Ismael Izaguirre
*Attorney, Agent, or Firm*—Poms, Smith, Lande & Rose

[57] ABSTRACT

A feeding device for feeding elastic strip material to a sewing machine feeding a strip in response to one or more control signals. The strip feeder uses a feed roller having an associated pressure roller to provide a feed nip with the feeding roller, a sensor directly senses the rate of feed of the strip and generates one or more sensing signals. The sensor uses a signal generator which is a rotary pulse generator, or a photoelectric device for detecting marks on the strip. A controller receives the sensing signals and generates control signals for controlling the rate of feed of the strip.

18 Claims, 1 Drawing Sheet

FEEDING DEVICE HAVING CONTROL MEANS, FEED ROLLERS, A PULSE GENERATOR AND A PHOTOELECTRIC DEVICE FOR DIRECTLY MEASURING RATE OF FEED OF AN ELASTIC STRIP HAVING MARKS THEREON FOR A SEWING MACHINE

FIELD OF THE INVENTION.

This invention relates to a feeding device for a sewing machine and more particularly concerns a feeding device which is adapted for feeding to a sewing machine elastic strip material to be sewn into a garment.

DESCRIPTION OF PRIOR ART.

The elastic strip material may be of the type described in our U.K Patent No. 1406821; examples of suitable strip material are available under the registered Trade Marks "BONADEX", "TRICOFLEX" and "PLEATEX".

It is known to feed elastic strip material to a sewing machine through guide means to fold a portion of a garment fabric around the strip ready for sewing. It is also known to feed the strip to a sewing machine under tension so that after sewing into the garment it relaxes to produce an elasticated portion of the garment, e.g. a waistband.

Sometimes intermittent elastication is desired in a portion of a garment and this can be achieved by sewing in discrete lengths of elastic strip material or by using an intermittent tensioning technique such as that described in our copending application No. 8605501.

It is also known to control the tension in an elastic strip of material being fed to a sewing machine in response to the speed of rotation of a portion of the sewing machine.

SUMMARY OF THE INVENTION.

It is an object of the present invention to provide an improved feeding device for feeding elastic strip material to a sewing machine.

According to the present invention a feeding device for feeding elastic strip material to a sewing machine comprises strip feeding means arranged to feed strip in response to one or more control signals, sensing means arranged to sense the rate of feed of the strip and to generate one or more sensing signals and control means arranged to receive said sensing signals and to generate control signals for controlling the strip feeding means.

The strip feeding means preferably comprises a roller having an associated pressure roller to provide a feed nip with the feeding roller. The feeding roller may be driven by a motor which, advantageously, is a stepper motor.

The sensing means may also comprise a roller arranged to be rotated by the strip as it is fed to the sewing machine. The roller may be connected to a signal generator which is conveniently a rotary pulse generator.

Alternatively the sensing means may comprise detecting means arranged to detect features of the strip, or means associated with the strip, to produce sensing signals dependent upon the rate of feed or extension of the strip. Such detecting means may, for example, be arranged to detect marks on the strip which are spaced a predetermined distance apart when the strip is in a relaxed condition.

The control means is arranged to provide the desired control signals in response to sensing signals to adjust the feed rate to a required rate.

The control means is preferably an electronic signal processing device having a display panel and may also be provided with adjusting means, conveniently manually operable adjusting means.

Conveniently the control means can be preset to provide a plurality of preset feed rates and switch means are provided to switch from one preset feed rate to another. Such an arrangement enables an operator to switch from one extension to a different extension in the strip fed to the sewing machine, e.g. intermittent elastication. The switch means may be controlled automatically according to a pre-programmed pattern, or by automatic sensing, such as a position sensing device or stitch count. Alternatively it may be operator-controlled e.g. by means of a knee-switch, foot-switch or hand switch.

BRIEF DESCRIPTION OF THE DRAWINGS.

Reference is now made to the accompanying drawings, in which.

DESCRIPTION OF THE PREFERRED EMBODIMENTS.

Figure 1:
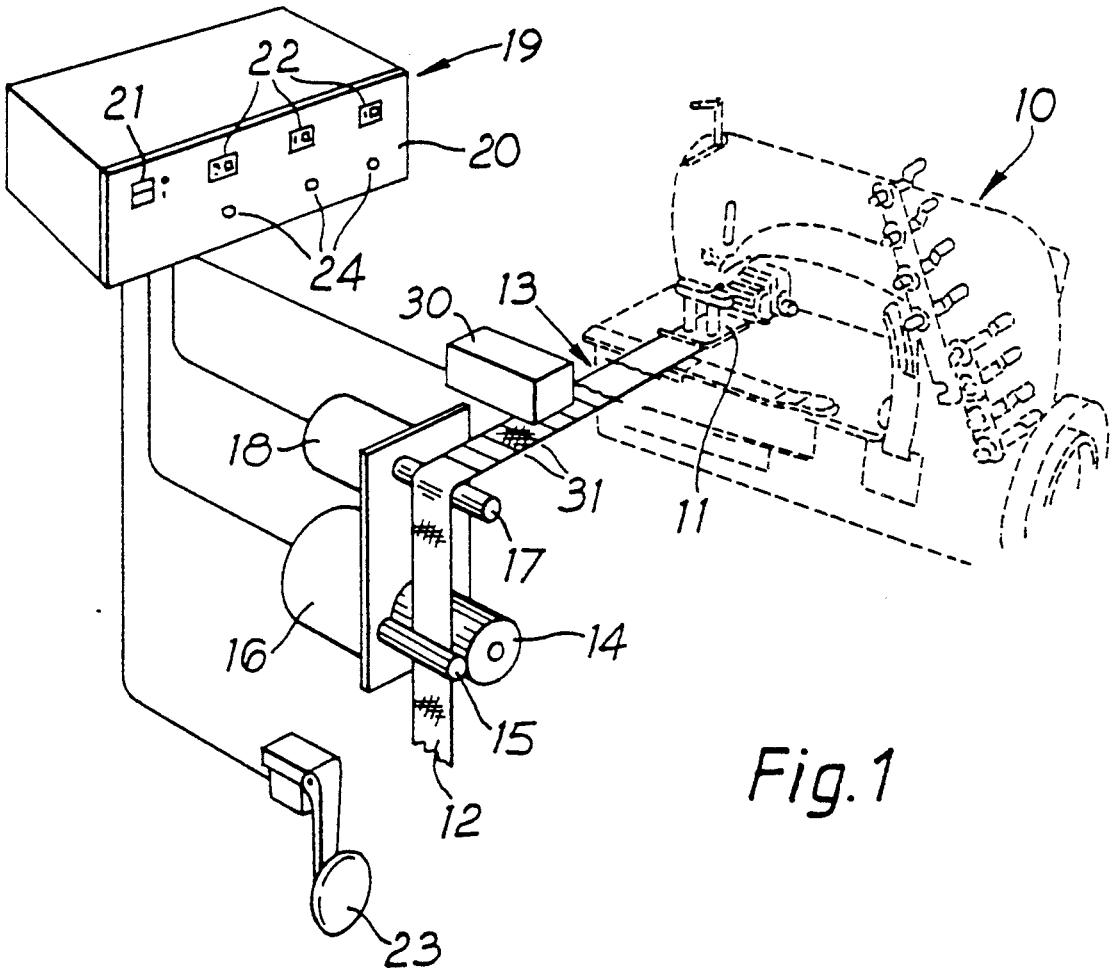
FIG. 1 is a schematic diagram of a device according to the invention shown associated with a representation of a sewing machine in dashed lines.

Referring to FIG. 1 a conventional sewing machine is shown in dashed lines at 10. The machine has a presser foot 11 to which an elastic strip material 12 is fed together with a garment (not shown) by way of a guide and/or folding device located in the region 13.

The feed device comprises feeding means in the form of a knurled device roller 14 and associated knurled pressure roller 15, the device roller being arranged to be driven by a stepper motor 16.

The sensing means comprises a roller 17 connected to a rotary pulse generator 18 which is capable of generating a series of signals determined by the speed of rotation of the roller 17 and hence the feed rate of the strip 12.

The pulse generator 18 is connected to a control means 19 which is capable of processing the sensing signals from the pulse generator 18 to produce control signals which are passed to the stepper motor 16.

The pulse generator 18 includes a control panel 20 which includes an on/off switch 21 and three set switches, such as thumbwheel switches, 22 which serve to pre-set three different extensions for the strip 12. The knee-switch 23 serves to enable an operator to switch from one set switch extension to the next. The set switch which is operated is indicated by illumination of the appropriate indicator light 24.

The device operates as follows. Actuation of the sewing machine 10 causes elastic strip 12 to be drawn towards the presser foot 11. The extension of the strip 12 is determined by the rate of feed which is governed by the rate of rotation of the stepper motor 16 and hence the roller 14. The pulse generator 18 measures the rate of feed of the strip 12 and feeds sensing signals to the control unit which generates control signals to the stepper motor 16 to provide the appropriate feed rate to give a desired extension to the strip 12.

Where the device is used to provide intermittent elastication in, for example, a waistband, elastic strip 12 is fed under a certain extension determined by the setting of the control unit. When a non-elasticated portion of the waistband is desired the control unit is switched to the next setting (which may for example be zero extension) and the control signals generated will cause the stepper motor 16 to feed strip 12 at a greater rate until the extension of the strip is reduced to the desired value (for example zero). As soon as the desired extension is achieved the feed rate will be such as to maintain that extension until the control unit setting is changed.

When the change of setting requires the extension of the strip to be increased it is necessary to rotate the stepper motor 16 in the reverse direction until the desired extension is achieved. This may be inconvenient and an alternative way of increasing the extension could be preferred. Such an alternative way could be to move the feed unit as a whole to provide the increased extension or to interpose an extension device.

Figure 2:
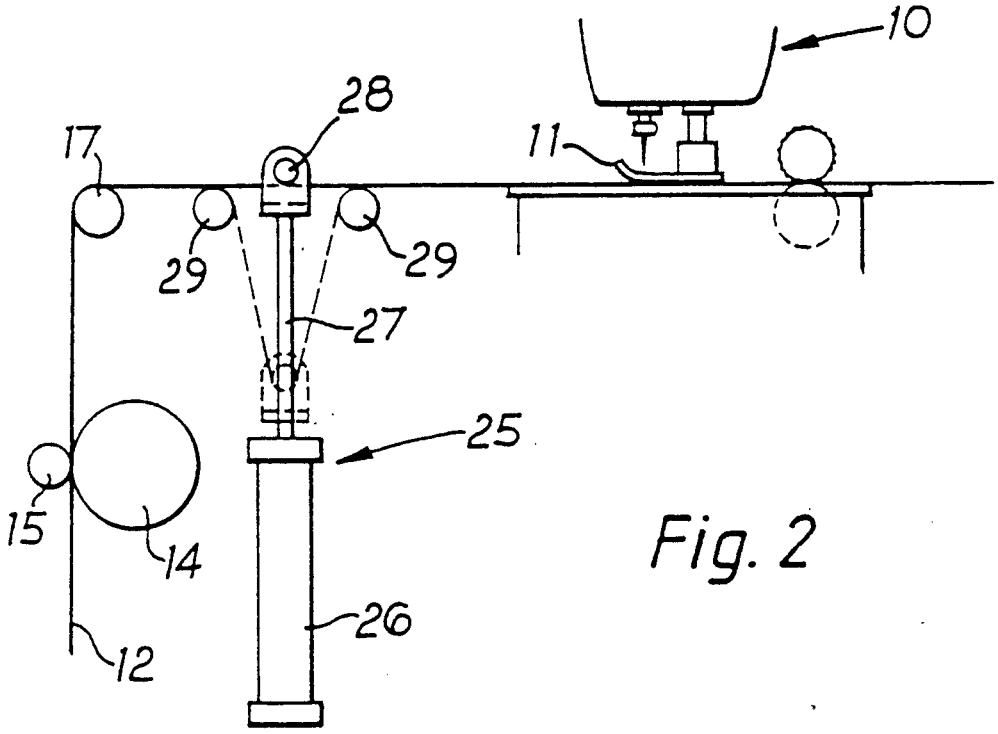
FIG. 2 is a schematic diagram of a pre-tensioning device for use with the device of FIG. 1.

An example of a suitable extension device is shown diagrammatically in FIG. 2. A device 25 comprising a cylinder 26 and a rod 27 is connected to a movable roller 28 disposed between two fixed rollers 29. The strip 12 is fed between the rollers as shown in the drawing. It will be seen that retraction of the rod 27 and the movable roller 28 to the position shown in dashed lines will increase the extension of the strip 12 and extending the rod 27 will decrease the extension of the strip 12. Any intermediate position can be chosen to give the desired extension.

The device according to the invention affords a number of advantages over devices at present employed for feeding elastic strip to a sewing machine. Prior feed devices have sensed a moving component of the sewing machine such as the handwheel. This has the disadvantage that the feed device is not an independent unit. Furthermore, the device of the present invention is able to respond to the extension of the strip and is therefore accurate whereas the prior devices, which sense the sewing machine, do not allow for variations in the rate of feed of the strip through the presser foot relative to the rate of rotation of the handwheel, for example, due to machine wear, change of stitch-length setting or slippage.

A further advantage of the device of the invention is that the elastic can be fed independently of the operation of the sewing machine e.g. by hand, to avoid stitching at the start or finish of a waistband to facilitate the finishing thereof.

Prior devices have also measured the tension in the strip e.g. by means of a load cell. Load cells are not accurate over a wide range of tensions and also provide an analogue measurement. The device of the present invention provides digital measurement of rate of feed and a digital feed thereby ensuring greater accuracy.

In an alternative arrangement the pulse generator can be replaced by a device, 30 e.g. a photoelectric device, which detects marks 31 provided on the elastic strip at a predetermined spacing. Furthermore, whilst a stepper motor is preferred beacause of the precise control which can be achieved, other means may be used.

The device of the invention has the advantage that it can be used with different sewing machines without any modification of the machines being required. Furthermore, whilst the device has been described specifically for use in feeding elastic strip to a sewing machine it can be used to feed other devices for example in the manufacture of the elastic strip.

I claim:

1. A feeding device for feeding elastic strip material to a sewing machine comprises strip feeding means arranged to feed strip in response to at least one control signals, sensing means arranged to directly sense the rate of feed of the strip and to generate at least one sensing signals and control means arranged to receive said sensing signals and generate control signals for controlling the strip feeding means.

2. A feeding device according to claim 1 wherein the strip feeding means comprises a roller having an associated pressure roller to provide a feed nip with the strip feeding roller.

3. A feeding device according to claim 2 wherein the strip feeding roller is driven by a motor.

4. A feeding device according to claim 3 wherein the motor is a stepper motor.

5. A feeding device according to claim 1 wherein the sensing means also comprises a roller arranged to be rotated by the strip being fed to the sewing machine.

6. A feeding device according to claim 5 wherein the roller is connected to a signal generator.

7. A feeding device according to claim 5 wherein the signal generator is a rotary pulse generator.

8. A feeding device according to claim 1 wherein the sensing means comprises detecting means arranged to detect physical features present on the strip to produce sensing signals dependent upon the rate of feed.

9. A feeding device according to claim 8 wherein the detecting means is arranged to detect marks on the strip spaced a predetermined distance apart when the strip is in a relaxed condition.

10. A feeding device according to claim 1 wherein the control means is arranged to provide the desired control signals in response to said at least one sensing signal to adjust the feed rate to a required rate.

11. A feeding device according to claim 10 wherein the control means is presettable to provide a plurality of preset feed rates and switch means are provided to switch from one preset feed rate to another.

12. A feeding device according to claim 11 wherein the switch means is controlled automatically according to a pre-programmed pattern.

13. A feeding device according to claim 11 in which the switching means is controlled by automatic sensing.

14. A feeding device according to claim 13 in which the switch means is controlled automatically according to a position sensing device.

15. A feeding device according to claim 13 in which the switch means is controlled automatically according to a switch count.

16. A feeding device according to claim 1 wherein the control means is in an electronic signal processing device having a display panel.

17. A feeding device according to claim 16 wherein the electronic signal processing device is provided with an adjusting means, said adjusting means is a manually operable adjusting means.

18. In combination a feeding device for feeding elastic strip material to a sewing machine the device comprising strip feeding means arranged to feed strip in response to at least one control signal, sensing means arranged to sense the rate of feed of the strip and to generate at least one sensing signal and control means arranged to receive said sensing signals and to generate control signals for controlling the strip feeding means wherein the sensing means comprises detecting means arranged to detect marks on the strip spaced a predetermined distance apart when the strip is in a relaxed condition whereby to produce sensing signals dependent on the rate of feed, said strip feeding means including a strip, the strip having marks thereon spaced a predetermined distance apart when the strip is in a relaxed condition.

* * * * *